US005092211A

United States Patent [19]

Petrovich et al.

[11] Patent Number: 5,092,211

[45] Date of Patent: Mar. 3, 1992

[54] SAW CHAIN HAVING CUTTER LINK WITH CENTRAL PIVOT ON BOTTOM EDGE

[75] Inventors: Michael V. Petrovich, Camas, Wash.; Donald J. MacGavin, Grover, Mo.

[73] Assignee: Blount, Inc., Montgomery, Ala.

[21] Appl. No.: 756,033

[22] Filed: Sep. 6, 1991

[51] Int. Cl.[5] ..... B27B 33/14

[52] U.S. Cl. ..... 83/830; 83/834

[58] Field of Search ..... 83/830, 831, 832, 833, 83/834

[56] References Cited

U.S. PATENT DOCUMENTS

| | | | |
|---|---|---|---|
| 4,122,741 | 10/1978 | Engman et al. | 83/834 |
| 4,567,803 | 2/1986 | Anderson | 83/833 |
| 4,573,386 | 3/1986 | Lindemann et al. | 83/833 |
| 4,643,065 | 2/1987 | MacGavin | 83/830 |
| 4,750,395 | 6/1988 | Doiron | 83/834 |
| 4,898,057 | 2/1990 | Hille | 83/831 |

*Primary Examiner*—Frank T. Yost
*Assistant Examiner*—Eugenia A. Jones
*Attorney, Agent, or Firm*—Klarquist, Sparkman, Campbell, Leigh & Whinston

[57] ABSTRACT

A saw chain is disclosed which includes cutting links having a central pivot on the bottom or inner edge of such cutting link which contacts the track of a saw bar on which the chain is mounted. A front foot portion and a rear foot portion which extend from the central pivot to the front end and the rear end, respectively, of the cutting link are normally spaced from such track when it is not cutting. The cutting link tilts about the pivot rearwardly and forwardly during cutting to provide a smooth rocking motion which reduces vibration and injury to the operator. One embodiment of the cutting link employs a single pivot located centrally between the front rivet opening and rear rivet opening. Another embodiment of the cutting link employs two pivots which are spaced apart and are both located centrally between the front and rear rivet openings. The saw chain includes side cutting links and side tie strap links connected by rivets to central drive links. Such drive links may also be provided with guard portions which extend outward in front of depth gauge portions of the cutting links to reduce kickback.

20 Claims, 3 Drawing Sheets

SAW CHAIN HAVING CUTTER LINK WITH CENTRAL PIVOT ON BOTTOM EDGE

BACKGROUND OF INVENTION

The subject matter of the present invention relates generally to saw chain for chain saws and in particular to saw chain having cutter links with a central pivot on the bottom edge of such cutter link which contacts the saw bar track to tilt the cutter link backward and forward during cutting to reduce vibration.

As saw chain is moved along the track of the saw bar of a chain saw it causes considerable vibration when the cutter links of such chain engage wood during cutting. This vibration is produced at least in part because the cutter links dig into the wood and tend to rear up when they pivot about the rear foot portion of the cutter link on the saw bar which raises the depth gauge portion and causes the cutter link to reduce its cutting edge penetration. When the cutter cuts through the wood to produce a severed wood chip it pivots back down so that its front foot portion contacts the saw bar track with considerable force. The repeated back and forth pivoting of the cutting link results in a hammering action on the saw bar thereby producing vibration which is transmitted to the hands of the chain saw operator. This vibration can cause injury to the hands of the operator of various types including Raynaud's Syndrome, numbness, muscle fatigue, tendonitis and the like. Previous attempts to solve this saw chain vibration problem have not been entirely successful.

As shown in U.S. Pat. No. 4,567,803 of Anderson, issued Feb. 4, 1986, it is known to provide a so-called anti-kick safety saw chain with guard links mounted in front of the cutter links to prevent the depth gauge or other portion of the cutter links from digging into the wood and causing kickback. In order to reduce the vibration of such a safety chain, it has been proposed in U.S. Pat. No. 4,643,065 of MacGavin, issued Feb. 17, 1987, to provide such guard links with a rear foot portion which is cut away to space such rear portion from the saw bar to enable the safety link to pivot without impacting such saw bar and reduce vibration.

An early attempt to reduce vibration of a conventional saw chain without guard links is shown in U.S. Pat. No. 4,122,741 of Engman, et al., issued Oct. 31, 1978. The Engman patent shows a saw chain having a side cutter link with the rear foot portion or heel at the bottom of the cutter link cut away to raise up and space such heel from the saw bar. The side link tie strap on the opposite side of the chain from such cutter is also provided with a raised heel portion spaced from the saw bar. This raised heel causes the cutting link to pivot about a front foot portion which contacts the saw bar track under the front rivet during cutting so that the cutting edge of the cutter link tends to pivot downward, thereby lowering the cutting edge rather than raising it to prevent such cutting edge from further digging into the wood as occurs when such cutter link pivots about a rear foot under the rear rivet. In a second embodiment, this patent provides a cutter link in which both the front foot portion and rear foot portion of such link are cut away and raised up so they are spaced from the saw bar during cutting. This causes the chain to pivot about the rear rivet of the preceding side link tie strap thereby even more effectively preventing the cutting edge of the cutter link from raising during cutting to reduce vibration.

U.S. Pat. No. 4,573,386 of Lindemann, et al., issued Mar. 4, 1986, shows a saw chain in which the rear foot portion of the cutter link is cut away so that such rear foot portion contacts the saw bar only at a tilt point ahead of the rear rivet opening to cause the cutter link to tilt about the tilt point. This reduces the amount of tilt elevation of the cutting edge when such cutter link engages wood thereby reducing tilt displacement of the cutting edge during cutting and partially reducing vibration. However, the front foot portion of the cutting link engages the saw bar at a position ahead of the forward rivet opening so that cutting results in continued tilting of the cutter link up and down about the tilt edge causing the front foot portion of the cutter link to slam repeatedly into contact with the saw bar with a hammering action which still transmits considerable vibration to the saw bar and the chain saw operator's hands.

Other attempts to reduce vibration in saw chain operation include using a center drive cutter link as shown in U.S. Pat. No. 4,898,057 of Hille, issued Feb. 6, 1990. In this chain the side link tie strap connected to the rear rivet of the center cutter link has been shaved away at its front foot portion to space such front foot away from the saw bar. Here again, this reduces tilt displacement of the cutting edge by causing the center cutter link to pivot about its forward rivet rather than its rearward rivet which results in the cutting edge moving downward rather than raising further into the wood when it engages the wood during cutting. However, a center cutter link saw chain is not as desirable in some circumstances as saw chain with side cutter links which employs alternate cutters on opposite sides of the chain with left-handed and right-handed cutter congfiguration for more efficient cutting.

The saw chain of the present invention employs side cutter links of improved design with a central pivot which contacts the saw bar to tilt about such pivot for reduced vibration and efficient cutting.

The cutter link of the present invention has a rear foot portion extending from a central pivot to the rear of the cutter link which is normally spaced from the track of the saw bar. In addition such cutter link has a front foot portion extending from such pivot to the front end of the cutter link which is also normally spaced from said track. This allows the cutter link to pivot or tilt about the central pivot in both a rearward and a forward direction by a significant amount without striking the saw bar with either the front or rear foot portion of the cutter thereby reducing vibration during cutting. In one embodiment of the present invention, the central pivot is provided by a single pivot point located centrally of the forward rivet opening and the rearward rivet opening of the cutter link. In another embodiment the pivot is provided by a pair of central pivot points longitudinally spaced apart and both located between the forward rivet opening and the rearward rivet opening of the cutter link. In addition, the tie strap side link on opposite side of the saw chain from the cutter link is provided with a central pivot located between the forward rivet opening and the rearward rivet opening of such tie strap which contacts the saw bar for tilting about such pivot in a similar manner to the cutter link. The saw chain of the present invention not only reduces vibration but also operates with efficient cutting by employing side cutter links with right-handed and left-handed cutters alternating along the length of such chain. The saw chain may be provided with a guard link portion on the top of the center drive link to protect the front of the depth gauge of the cutter link thereby reducing kickback. Thus, the cutting chain of the present invention operates in a safer manner than cutting chains not employing such guard links.

SUMMARY OF INVENTION

It is therefore one object of the present invention to provide an improved saw chain for cutting wood with less vibration by employing a cutter link with a central pivot on the bottom or inner edge thereof to enable the cutter link to pivot in a forward and rearward direction on the track of the saw bar during cutting.

Another object of the invention is to provide such a saw chain in which the central pivot of the cutter link is located forward of the rear rivet opening and rearward of the front rivet opening of such cutter link to allow the cutter link to tilt about such pivot without raising the cutting edge of such cutter link significantly during cutting.

A further object of the invention is to provide such a saw chain in which the cutting link is a side cutting link and a side tie strap link is provided on the opposite side of the chain from such cutting link with such tie strap link also being provided with a central pivot between the front and rear rivet openings which contacts the track of the saw bar while the front foot portion and the rear foot portion of such tie strap link are spaced from the saw bar to enable pivoting in a forward and rearward direction on the saw bar.

An additional object of the present invention is to provide such a saw chain in which the side cutter links are left-handed and right-handed cutter links on opposite sides of the chain which alternate with distance along the chain for efficient cutting.

Another object of the invention is to provide such a saw chain in which the center drive link is provided with a guard link portion in front of the cutter link which protects the depth gauge portion of the cutter link to reduce kickback for greater safety.

Still another object of the invention is to provide such a saw chain in which the cutter link has a central pivot provided by a single pivot point which is located centrally between the forward rivet opening and the rearward rivet opening and has a front foot portion normally spaced from the saw bar when not cutting, extending from the single pivot point to the front end of the cutting link and has a rear foot portion normally spaced from the saw bar which extends from the single pivot point to the rear end of the cutting link to reduce vibration.

A still further object of the present invention is to provide such a saw chain in which the cutter link is provided with a central pivot in the form of a pair of pivot points which are located in a central foot portion rearward of the front rivet opening and forward of the rear rivet opening of the cutter link to further reduce vibration.

DESCRIPTION OF DRAWINGS

Other objects and advantages of the present invention will be apparent from the following detailed description of certain preferred embodiments thereof and from the attached drawings of which.

DESCRIPTION OF PREFERRED EMBODIMENTS

Figure 1:
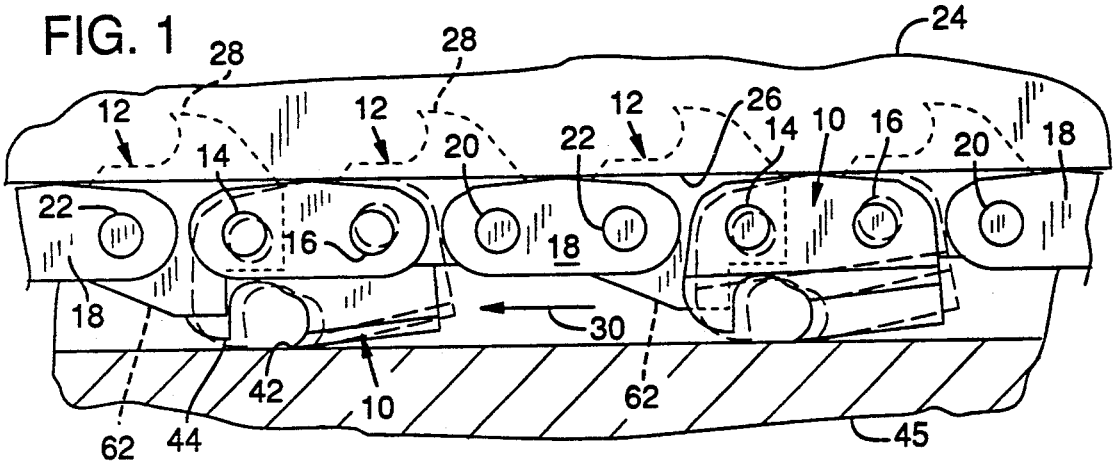
FIG. 1 is an elevation view of a portion of a chain saw apparatus including the improved saw chain of the present invention mounted upon a saw bar showing engagement of the cutter links and tie strap links with the track rails of such saw bar while the saw chain is cutting wood.
Figure 2:
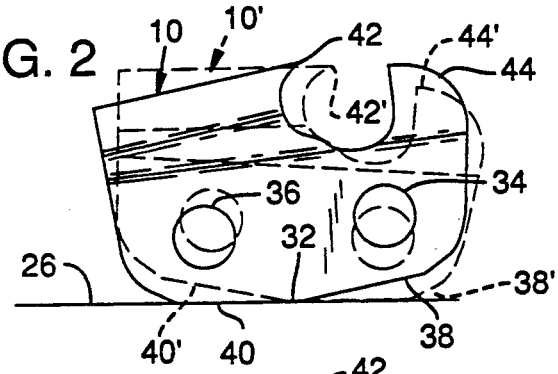
FIG. 2 is an enlarged view of an improved cutting link of the saw chain of FIG. 1 made in accordance with one embodiment of the present invention.

As shown in FIGS. 1 and 2, one embodiment of the saw chain apparatus of the present invention includes a saw chain having side cutter links 10 which are pivotally connected to center drive links 12 by front rivets 14 and rear rivets 16. The drive links 12 are interconnected by tie strap side links 18 which are connected by front rivets 20 and rear rivets 22 to such drive links. The interconnected links form an endless loop of saw chain which moves along a saw bar 24. The saw bar 24 has a guide track for guiding movement of the saw chain along such saw bar. The guide track includes a pair of track rails 26 separated by a track groove. The drive links 12 have depending drive tangs 28 which extend into the track groove. The bottom or inner edges of the side links including the cutter links 10 and the tie strap links 18 engage the track rails 26 and slide along such track rails as the chain is driven by the motor of the chain saw in a conventional manner in the direction shown by arrow 30.

Figure 5:
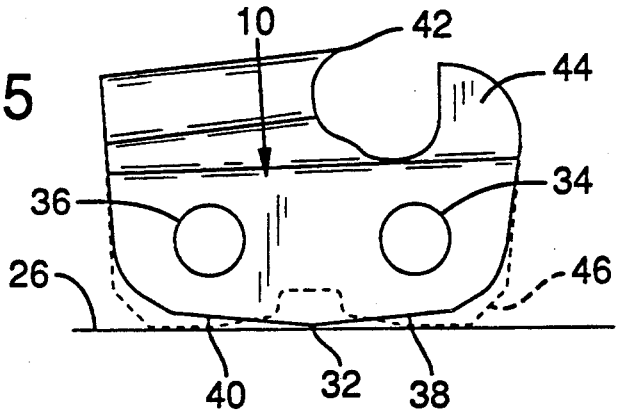
FIG. 5 is a side elevation view showing the cutter link of FIG. 2 superimposed over the conventional cutter link of FIG. 4 shown in dashed line.

As shown in FIG. 2, a cutter link 10 in accordance with the present invention, includes a central pivot 32 on a central foot portion of the bottom or inner edge of such cutter tooth which engages the saw bar track rail 26. The central pivot is positioned centrally between a forward pin or rivet opening 34 and a rearward pin or rivet opening 36. A front foot portion 38 at the bottom or inner edge of the cutting link extends from the central pivot 32 to the front end of the cutting link 10 and is normally spaced from the saw bar track 26 when not cutting as such cutting link moves along a straight portion of the track as shown in FIGS. 1 and 5. The cutting link 10 also includes a rear foot portion 40 which extends from the central pivot 32 to the rear end of the cutting link. Such rear foot portion is also normally spaced away from the saw bar track 26 when not cutting, as shown in FIGS. 1 and 5.

The cutting link 10 includes a cutter portion having a cutting edge 42 provided at the top or outer edge of the cutting link. A depth gauge portion 44 extends upward from the front of the cutter link body at a position ahead of the cutting edge to limit the depth of penetration of the cutting edge into the wood. In the normal position of the cutting link 10, shown in FIG. 1, the cutting edge 42 extends slightly above the top of the depth gauge 44 so that such cutting edge engages the wood article 45 being cut to produce the saw kerf.

As shown in FIG. 2, when the cutting edge 42 cuts into the wood it tends to pivot the cutting link backwards from the normal position of FIG. 5, to the rearward tilted position 10 shown in solid lines in FIG. 2. Since the central pivot 32 is the only portion of the bottom or inner edge of the cutting link which engages the saw bar track 26 in the normal position of such cutting link, the cutting link tilts backward about pivot 32 during cutting from the normal position into the tilted position 10 where the rear foot portion 40 engages the track 26. This raises the depth gauge portion from the normal position shown in FIG. 5 to the raised position 44 shown in solid lines in FIG. 2 which tends to further limit the depth of cut of the cutting edge 42 into the wood. As a result, the cutting edge breaks free of the wood and the cutter link 10 tilts forward about the pivot 32 into a forward tilted position 10'. The normal tension on the saw chain while it is moved by the drive sprocket acts as a spring to urge the cutting link 42 into a horizontal position. Thus, as the cutting link is moved by external forces on the cutting edge 42 and the depth gauge 44 from its normal horizontal position the chain tension provides a restoring force that together with the recessed foot portions 38 and 40 and central pivot 32, reduces the impact of the cutting link on the saw bar while such cutting link rocks forward and backward.

Figure 4:
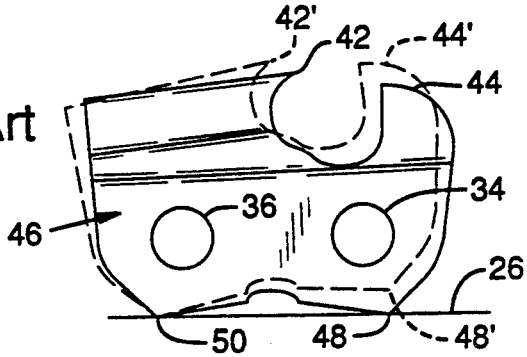
FIG. 4 Prior Art
FIG. 4 is a side elevation view of a prior art cutter link.

In contrast, a conventional side cutting link 46 is shown in FIG. 4 which is similar to the cutting link of the present invention shown in FIG. 2 but does not have a central pivot 32 or raised foot portions 38 and 40 on its bottom or inner edge. Instead, the prior cutting link 46 includes a front foot portion 48 which normally contacts the saw bar track 26 at a point beneath or forward of the front rivet opening 34. Similarly, such cutter link includes a rear foot portion 50 which contacts the track 26 at a point beneath or rearward of the center of the rear rivet opening 36. As a result, when the prior cutter link 46 engages the wood with its cutting edge 42 such cutting link pivots about the rear foot portion 50 causing the cutting edge 42, the depth gauge 44 and the front foot 48 to raise from the solid line position to the dashed line position thereby resulting in reduced penetration of the cutting edge until it breaks free of the wood. This causes a violent tilting of the cutter link 46 backward and forward from the solid line position to the dashed line position and back to the solid line position so that the front foot portion 48 and the rear foot portion 50 both slam into the track 26 with a hammer-like impact. The result is considerable vibration which is transmitted through the saw bar to the hands of the operator causing numbness, thought to contribute to Raynaud's Syndrome. This vibration problem is greatly reduced by the smooth tilting operation of the cutting links of the present invention.

Figure 3:
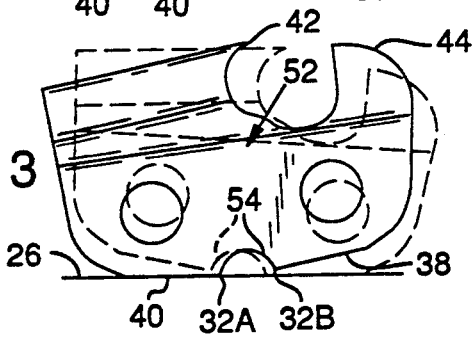
FIG. 3 is an enlarged side elevation view of another cutter link made in accordance with a second embodiment of the present invention.
Figure 6:
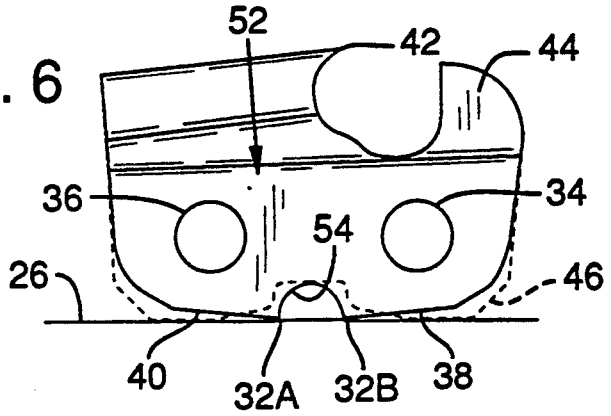
FIG. 6 is a side elevation view of the cutter link of FIG. 3 shown superimposed over the conventional cutter link of FIG. 4 which is shown in dashed lines.

Another embodiment of the cutting link of the present invention shown in FIGS. 3 and 6 is a double central pivot cutting link 52 which is similar to the embodiment shown in FIGS. 2 and 5 except that it employs a pair of central pivots 32*a*, 32*b* which in the normal position of the cutter link when not cutting, both of such pivots contract the saw bar track 26 as shown in FIG. 6. The two central pivot points 32*a*, 32*b* are spaced apart by a U-shaped notch 54 in the bottom of the cutter tooth. However, both central pivots 32*a*, 32*b* are positioned in a central foot portion located between the front rivet opening 34 and the rear rivet opening 36 of the cutting link. In addition, the front foot portion 38 and the rear foot portion 40 which, respectively, extend from the front pivot point 32*b* to the front end of the link and from the rear pivot point 32*a* to the rear end of the link are normally spaced from the saw bar track 26, as shown in FIG. 6. However, since both of the central pivots 32*a*, 32*b* are located behind the forward rivet opening 34 and ahead of the rear rivet opening 36 of the cutter link, this distinguishes cutting link 52 of FIG. 6 from the prior cutter link 46 of FIG. 4.

When the cutting link 52 engages wood during cutting it tilts backward about a first central pivot point 32*a* until the raised rear foot portion 40 of such link contacts the track 26 as shown in solid lines in FIG. 3. When this happens, there is very little vertical displacement of the cutting edge 42 because the central pivot 32*a* is close to a vertical line through such cutting edge. Thus, in the prior cutter link 46 of FIG. 4 the rear pivot 50 is much further displaced horizontally from a vertical line through the cutting edge 42' than the central pivot 32*a* of the second embodiment is displaced from the cutting edge of the cutting link 52 of the present invention. The same is true of the second central pivot point 32*b* about which the cutting link pivots in a forward direction into forward tilted position 52' in FIG. 3 until the raised front foot portion 38 engages the track 26. Thus, the second central pivot 32*b* is much closer to a vertical line through the cutting edge than is the front pivot 48 on the front foot of the conventional cutter link 46 of FIG. 4. Also, the normal chain tension urges the cutting links 52 into a horizontal position which provides a restoring force that tends to prevent the front and rear foot portions from impacting the saw bar or reduces such impact. As a result, the cutter link of FIG. 6 has a smooth tilting action about the pivots 32*a*, 32*b* which greatly reduces vibration and the hammering action of the front and rear feet when the front and rear feet engage the track.

Figure 7:
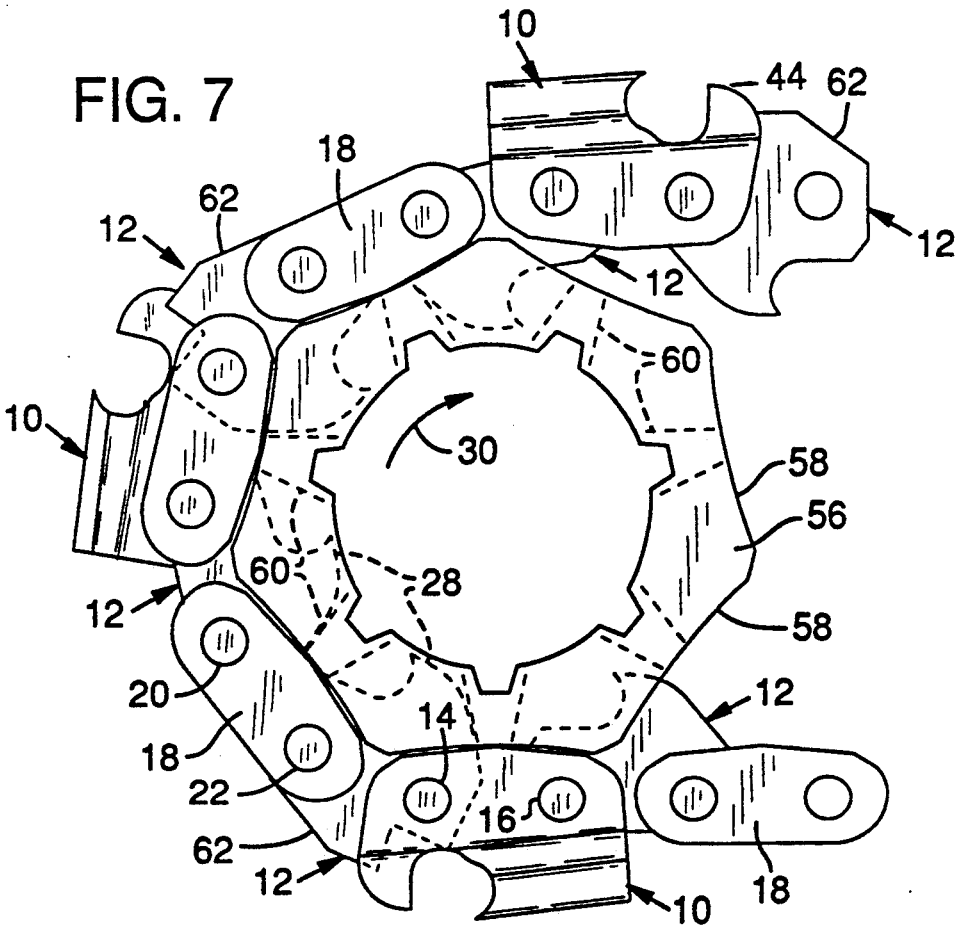
FIG. 7 is an enlarged view of one end of the saw chain of FIG. 1 as it moves around a rim drive sprocket for driving such chain during cutting along the track of the saw bar.
Figure 8:
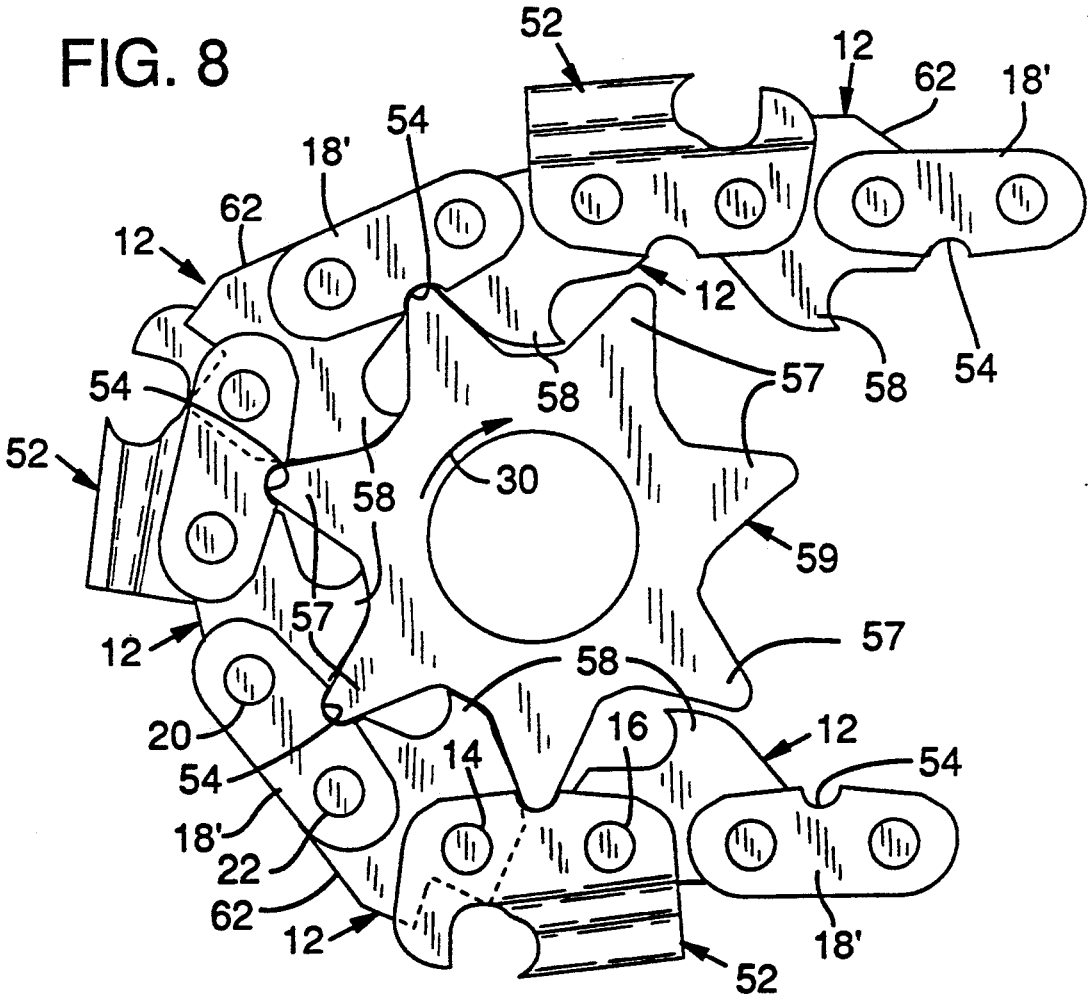
FIG. 8 is an enlarged view of one end of a saw chain with the cutting links of FIG. 3 as it moves around a spur tooth drive sprocket.

When the improved cutting link !0 of FIG. 2 with a single central pivot 32 is employed in the saw chain a special drive sprocket 56 must be employed for driving the saw chain due to the fact that there is no notch in the bottom edge of such saw chain which can be engaged by sprocket teeth. The drive sprocket 56 is provided with a sprocket rim consisting of a plurality of curved rim segments 58 which each have a shape to conform to the bottom of the cutting link 10 and to the bottom of the tie straps 18. Such a special drive sprocket is not necessary with the embodiment of the cutting link 52 shown in FIG. 6 because it is provided with a notch 54 on the bottom edge thereof between the two pivot points 32*a*, 32*b* which can be engaged by the tips of sprocket teeth 57 of a spur tooth sprocket 59 which does not have side plates or rims for the side links to ride on, as shown in FIG. 8. A similar notch would also be provided on the tie strap side links 18 used with such cutter link so that a conventional spur sprocket could be employed. It should be known that the drive tang portions 28 of the drive links 12 are received by the drive sprocket 56 between the sprocket teeth 60 as shown in FIG. 7 for driving the chain.

Also, it should be noted that the center drive links 12 are provided with a ramp-shaped guard portion 62 extending outward in front of the depth gauge 44 of the cutting links 10 or 52 in order to reduce kickback. In this regard, see U.S. Pat. No. 4,567,803 of Anderson referred to above.

It will be obvious to one having ordinary skill in the art that many changes may be made in the abovedescribed preferred embodiments of the invention. Therefore, the scope of the present invention should be determined by the following claims.

I claim:

1. A saw chain for a chain saw having a saw bar providing a track for guiding the movement of the saw chain, the saw chain comprising:

a plurality of cutting side links, a plurality of drive links and a plurality of connecting side links with said links being pivotally interconnected by pins to form an endless loop saw chain;

said cutting links each having a cutter portion at the outer edge of said cutting link, a foot portion at the inner edge of said cutting links, and a pair of longitudinally spaced pin openings including a forward opening adjacent the front end and a rearward opening adjacent the rear end of said cutting link;

said foot portion of the cutting links including a central foot portion which contacts a straight portion of the track of the saw bar between the forward pin opening and rearward pin opening, and said foot portion having a front foot portion which is normally spaced from said track when the cutting link is not cutting and extends from said central foot portion to the front end of the cutting link and having a rear foot portion which is normally spaced from said track and extends from said central foot portion to the rear end of the cutting links; and said central foot portion providing a pivot on said saw bar track for said cutting link to tilt backward and forward about said central pivot during cutting while reducing the impact of the front and rear foot portions with said track to lower vibration.

2. A saw chain in accordance with claim 1 in which the central foot portion has a single pivot region which contacts the saw bar track.

3. A saw chain in accordance with claim 2 in which the single pivot region is a single pivot point.

4. A saw chain in accordance with claim 1 in which the central foot portion has a pair of longitudinally spaced pivot regions which contact the saw bar track.

5. A saw chain in accordance with claim 4 in which the pair of pivot regions are a pair of pivot points.

6. A saw chain in accordance with claim 1 in which the central foot portion is located substantially in the center of the distance between the forward and rearward pin openings.

7. A saw chain in accordance with claim 1 in which the central foot portion is substantially the same distance from the front end of the cutting link as the cutter portion of the cutting link.

8. A saw chain in accordance with claim 1 in which the front foot portion and the rear foot portion slope away from the saw bar track from said central foot portion to said front end and to said rear end of said cutting tooth.

9. A saw chain in accordance with claim 1 with the connecting side link also having a foot portion at the bottom of said connecting link and a pair of longitudinally spaced pin openings including a forward opening adjacent the front end and a rearward opening adjacent the rear end of said connecting link;

said foot portion of the connecting links including a central foot portion which contacts the track of the saw bar between the forward pin opening and the rearward pin opening of said connecting link, and said foot portion having a front foot portion and a rear foot portion which are normally spaced from said track when the cutting link is not cutting and which extend from said central foot portion to the front end and to the rear end, respectively, of the connecting links; and said central foot portion of said connecting link providing a pivot on said saw bar track for enabling said connecting link to pivot backward and forward about said central foot portion during cutting which reduces the impact of the front and rear foot portions with said track.

10. A chain saw apparatus including the combination of a saw chain and a saw bar providing a track for guiding the movement of the saw chain, the saw chain comprising:

a plurality of cutting links, a plurality of drive links and a plurality of connecting links with said links being pivotally interconnected by pins to form said saw chain;

said cutting links each having a cutter portion at the outer edge of said cutting link, a foot portion at the inner edge of said cutting links, and a pair of longitudinally spaced pin openings including a forward opening adjacent the front end and a rearward opening adjacent the rear end of said cutting link;

said foot portion of the cutting links including a central foot portion which contacts a straight portion of the track of the saw bar between the forward pin opening and rearward pin opening, and said foot portion having a front foot portion which is normally spaced from said track when the cutting link is not cutting and extends from said central foot portion to the front end of the cutting link and having a rear foot portion which is normally spaced from said track and extends from said central foot portion to the rear end of the cutting links; and said central foot portion providing a pivot on said saw bar track for said cutting link to tilt backward and forward about said pivot during cutting while reducing the impact of the front and rear foot portions with said track to lower vibration.

11. A saw chain in accordance with claim 10 in which the central foot portion has a single pivot which contacts the saw bar track.

12. A saw chain in accordance with claim 11 in which the single pivot is a single pivot point.

13. A saw chain in accordance with claim 10 in which the central foot portion has a pair of longitudinally spaced pivots which contact the saw bar track.

14. A saw chain in accordance with claim 13 in which the pair of pivots are a pair of pivot points.

15. A saw chain in accordance with claim 10 in which the central foot portion is substantially the same distance from the front end of the cutting link as the cutter portion of the cutting link.

16. A saw chain in accordance with claim 10 in which the front foot portion and the rear foot portion slope away from the saw bar track from said central foot portion to said front end and to said rear end of said cutting tooth.

17. A saw chain in accordance with claim 10 with the connecting link also having a foot portion at the bottom of said connecting link and a pair of longitudinally spaced pin openings including a forward opening adjacent the front end and a rearward opening adjacent the rear end of said connecting link;

said foot portion of the connecting links including a central foot portion which contacts the track of the saw bar between the forward pin opening and the rearward pin opening of said connecting link, and said foot portion having a front foot portion and a rear foot portion which are normally spaced from said track and which extend from said central foot portion to the front end and to the rear end, respectively, of the connecting links; and said central foot portion of said connecting link providing a pivot on said saw bar track for enabling said connecting link to pivot backward and forward about said central foot portion during cutting which reduces the impact of the front and rear foot portions with said track.

18. A saw chain cutting link, comprising:

a cutting link body including a cutter portion at the outer edge of said body and a pair of longitudinally spaced pin openings with a forward opening adjacent the front end and a rearward opening adjacent the rear end of the cutting link;

a foot portion at the inner edge of said body including a central foot portion which contacts a saw bar track between the forward pin opening and the rearward pin opening, a front foot portion which is normally spaced from said track when the cutting link is not cutting and extends from the central foot portion to the front end of the cutting link, and a rear foot portion which is normally spaced from the track and extends from said central foot portion to the rear end of the cutting link; and said central foot portion providing a pivot on the saw bar track for said cutting link to tilt backward and forward about said pivot during cutting which reduces the impact of the front and rear foot portions with said track to reduce vibration.

19. A cutting link in accordance with claim 18 in which the central foot portion has a single pivot which contacts the saw bar track.

20. A cutting link in accordance with claim 18 in which the central foot portion has a pair of pivots which contact the saw bar track.

* * * * *